United States Patent [19]

Shigematsu et al.

[11] Patent Number: 4,846,884

[45] Date of Patent: Jul. 11, 1989

[54] PROCESS FOR PRODUCING COLD-BONDED IRON ORE FOR USE IN A BLAST FURNACE

[75] Inventors: Tatsuhiko Shigematsu; Minoru Ichidate; Chitose Shiotani; Yohzi Tozawa, all of Amagasaki, Japan

[73] Assignee: Sumitomo Metal Industries, Ltd., Osaka, Japan

[21] Appl. No.: 904,757

[22] Filed: Sep. 5, 1986

Related U.S. Application Data

[63] Continuation of Ser. No. 698,827, Feb. 6, 1985, abandoned, which is a continuation of Ser. No. 425,999, Sep. 28, 1982, abandoned.

[51] Int. Cl.[4] ..... B28B 1/08; B29C 43/00; C21B 5/00; C22B 1/14

[52] U.S. Cl. ..... 75/3; 75/41; 75/42; 264/69; 264/118; 264/122

[58] Field of Search ..... 264/69, 109, 118, 122, 264/125; 266/197; 75/1 R, 3, 41, 42

[56] References Cited

U.S. PATENT DOCUMENTS

| | | | |
|---|---|---|---|
| 1,848,710 | 3/1932 | Gustafsson | 266/197 |
| 3,348,278 | 10/1967 | Jankovsky et al. | 264/69 |
| 4,093,451 | 6/1978 | Cass et al. | 264/109 |
| 4,116,679 | 9/1978 | Pietsch | 264/122 |
| 4,273,575 | 6/1981 | Litzinger et al. | 75/3 |
| 4,326,887 | 4/1982 | McAllister et al. | 75/3 |
| 4,369,062 | 1/1983 | Strange | 75/3 |
| 4,528,025 | 7/1985 | Goksel | 75/3 |

FOREIGN PATENT DOCUMENTS

| | | | |
|---|---|---|---|
| 0712449 | 1/1980 | U.S.S.R. | 266/197 |
| 1445792 | 8/1976 | United Kingdom | 75/3 |

*Primary Examiner*—Jan H. Silbaugh
*Assistant Examiner*—Karen D. Kutach
*Attorney, Agent, or Firm*—Burns, Doane, Swecker & Mathis

[57] ABSTRACT

A process for producing cold-bonded or non-fired iron ore which introduced as a charge into a blast furnace. The iron ore, which contains 10 to 70% of particles having a diameter ranging from 1 to 10 mm, is molded into a block, preferably by a pressure-molding method, a shock-molding method or a packing-molding method with vibrations. The block is then cured or hardened. This hardened block is crushed to have a predetermined shape. An additive such as CaO, $Al_2O_3$, or MgO may be added to the iron ore to adjust the basicity as a whole to 0.8 to 2.0. Moreover, the molding step is conducted so that the product may have a void volume equal to or less than 25%.

12 Claims, 9 Drawing Sheets

PROCESS FOR PRODUCING COLD-BONDED IRON ORE FOR USE IN A BLAST FURNACE

CROSS-REFERENCE TO RELATED APPLICATIONS

This application is a continuation of application Ser. No. 698,827, filed Feb. 6, 1985, now abandoned, which is a continuation of application Ser. No. 425,999, filed Sept. 28, 1982, now abandoned.

BACKGROUND OF THE INVENTION

1. Field of the Invention

The present invention relates to a process of producing cold-bonded iron ore to be used as a charge of a blast furnace and, more particulary, to a process of producing non-fired agglomerated iron ore to be used as the blast-furnace charge.

2. Description of the Prior Art

The properties required for the cold-bonded iron ore to be used in the blast furnace are itemized into the following four points: (1) it has a high cold strength; (2) it has a large angle of repose; (3) its disintegration during reduction is little; and (4) it has a high softening temperature. In the prior art, however, there is no cold-bonded iron ore which has succeeded in sufficiently satisfying those requirements.

As a representative of the cold-bonded iron ore, there are cold-bonded pellets which are prepared by adding a binder and a suitable amount of water to fine iron ore, as shown in the flow chart of FIG. 1. According to this prior art process, the iron ore is first ground. The ground iron ore fines are then mixed with additives and portland cement and are humidified. The resultant mixture is pelletized for subsequent classifications. The over-sized pellets are cured so that they may be hardened. The remaining undersized pellets are returned so that they may be reused in the process. The hardened pellets are classified again so that the over-sized may be used as a charge of the blast furnace when they attain a sufficient handling strength. On the other hand, the under-sized pellets are returned as one of the starting materials so that they may be subjected again to the iron-ore producing cycle thus far described. In this cycle, the ground iron ore fines usually have a particle diameter not exceeding 0.4 mm, and the cement acting as a hydraulic binder is not limited to the portland cement but can be blast-furnce cement or blast-furnace slag.

Nevertheless, the pellets thus produced have a defect that their distribution in the blast furnace is uneven because they have so spherical a shape that their angle of repose is small. More specifically, it is necessary for the stable operations of the blast furnace that the charge be distributed in a desired state, i.e., be overlaid evenly in the radial direction of the furnace. For that necessity, the charge such as the pellets is so adjusted that it is fed to the blast furnace with a radially even distribution. In case the charge is composed of spherical pellets, that adjustment is less effective so as to raise a problem when a plenty of the pellets are used, because they have a small angle of repose. In other words, the charge is concentrated locally at the center of the furnace to undesirably raise the ore/coke ratio at said position. As one answer for that problem, there has been made a proposal in which the pellets are crushed to endow a large angle of repose (as has been disclosed in Japanese Patent Laid-Open No. 56-35732).

It is further necessary to maintain the evenness of the gas flow through the blast furnace. Despite this fact, the gas flow loses its evenness because the cold-bonded pellets having the small angle of repose gather to the center portion of the blast furnace when they are fed thereto. In order to eliminate that defect intrinsic to the pellets, it is necessary to prepare a cold-bonded iron ore, which has a large angle of repose and its granular composition relatively resembling that of the sintered iron ore, thereby to make the blast-furnace charge distribution similar to that of the sintered iron ore so that the gas flow in the furnace may be made even to a satisfactory extent.

For this necessity, as is adopted in the sintered ore, there is a method in which the shapes of the cold-bonded pellets are improved by the crushing step. The pellets have a tendency to have an excessively small size for use as the charge of the blast furnace if they are crushed. Moreover, the pellets are liable to be disintegrated because their insides are loose despite their surfaces are sufficiently tight. Therefore, it has been believed that the improvement in the shapes by the crushing process is not preferable from the standpoint that the cold-bonded pellets are liable to be disintegrated.

In order to maintain the operation of the furnace under a good condition, the charge should have good properties at high temperatures (which will be shortly referred to as "hot properties"), particularly a high softening temperature. This softening temperature of the charge is dependent upon its chemical composition. More specifically, the gangue mineral contained in the charge reacts with iron monoxide (FeO) to produce a fluxing oxide having a low melting point, and this oxide melts to reduce the resistance to deformation thereby to deteriorate the hot properties under load and the air permeability, thus making the stable operation of the blast furnace difficult.

As methods of improving the hot properties of the cold-bonded pellets, therefore, there have been known to the prior art: (1) a method of improving the gangue mineral composition; and (2) a method of improving the reducibility of the pellets, as have been disclosed in Japan Patent Publication No. 53-13402 and in Japanese Patent Laid-Open Nos. 52-133003 and 52-117218, for example. However, those two methods (1) and (2) raise the following two problems [1] and [2]:

[1] Improvement in Gangue Mineral Composition

This is a method of improving the hot properties by adjusting the chemical composition of the gangue mineral (i) to increase the basicity to a high level, (ii) to add manganese oxide (MgO) as a basic material and to reduce the content of the gangue mineral so that the melting point of the fluxing oxide formed by the reaction of the gangue mineral and the FeO may be elevated to increase the resistance to deformation.

Generally speaking, the cold-bonded pellets require the addition of 8 to 10% of cement, which contains about 22% of $SiO_2$, 5% of $Al_2O_3$ and 65% of CaO. This not only results in increase in the gangue mineral content but also involves the inclusion of the acidic oxides $SiO_2$ and $Al_2O_3$. Thus, it becomes necessary to add a significant amount of limestone so as to increase the basicity. However, this amount of limestone gives rise to the gangue mineral content so that the pellets themselves have their qualities degraded and so that the amount of the gangue mineral content melting at high temperatures is increased to reduce the deformation resistance to softening shrinkage or contraction, thus deteriorating the hot properties. It, therefore, becomes necessary to use iron ore of higher grade for the cold-bonded pellets. In order to attain the hot properties, specifically, the iron ore of higher grade has to be used at a high basicity thereby to reduce the content of slag.

[2] Improvement in Reducibility

For this improvement, there has been developed two methods: the method in which the pellets have their porosity increased to smoothen the reducing gas flow therethrough; and the method in which a reducing agent such as fine coke is added to promote the reduction from FeO to metallic iron thereby to effect direct reductions at hot portions. Reference should be made to Japanese Patent Laid-Open Nos. 52-123916 and 53-10313, for example. Japanese Patent Laid-Open No. 56-55526 may also be referred to for the fired pellets of coarse iron ore.

According to the former method of increasing the porosity, however, in spite of the high reducibility, the cold strength and the strength during reduction are made the lower as the porosity is increased the more, thus undesirably causing the disintegration. According to the latter method of mixing the fine coke on the other hand, the resultant pellets have their cold strength lowered and their disintegration during reduction increased so that they are not desired as the charge of the blast furnace.

Thus, the improvement in the reducibility of the cold-bonded pellets is advantageous for the improvement in the hot properties because the generation of the metallic iron is accelerated while reducing the FeO content. Despite that advantage, problems such as reduction in the cold strength or disintegration at high temperatures are caused to make it necessary to search for another improving method.

As a measure for improving the cold strength, more specifically, there are improvements in (1) a method of adding an accelerator for accelerating the hardening of the binder, and (2) a curing method. The former method (1) is based upon a finding that the strength of the cold-bonded pellets is dependent upon the adhesion strength of the binder so that the cold strength is improved by adding a hardening accelerator (such as $Na_2CO_3$ or $CaCl_2$) of the binder, as has been disclosed in Japanese Patent Laid-Open No. 52-35116. The latter method (2) resorts to the fact that the cement usually used as a binder has its hardening strength increased by a hydration. This hydration itself can be promoted by a curing treatment at high temperatures. For this curing method, in a hot steam, reference should be made to Japanese Patent Laid-Open No. 51-103003, for example. Both of those methods (1) and (2) aim at shortening the curing period for which a predetermined strength is achieved, and the substantial strength level is adjusted by the content of the cement used.

However, both the methods are intended mainly to shorten the treatment period by promoting the hydration. Their merits, however, are not efficiently exhibited in case there is a wide place such as a yard where the cold-bonded pellets can be left for a long time. The use of the accelerator for accelerating the hardening of the binder is not preferred because such an agent is a salt or salts of alkaline metal will possibly invite either brittleness of coke in the blast furnace or damage of the refractory.

As a measure for improving the disintegration during reduction, on the other hand, there is also known a method in which the chemical composition of the gangue mineral is improved. By adjusting this composition to have a high basicity, according to the method, the phenomena (which will be shortly referred to as "swelling phenomena"), in which the pellets swell during reduction, can be prevented to thereby restrain the disintegration. In the case of the cold-bonded pellets, however, there arises another problem that the deterioration in the strength is observed, although the swelling phenomena can be prevented by adjusting the gangue mineral composition, thus making that method short of the efficiency as the method for restraining the disintegration during reduction.

Thus, all the methods thus far described in accordance with the prior art have failed to satisfy the measures for improving the cold strength and for preventing the disintegration during reduction. Therefore, it is earnestly desired to search for the more essential improving methods.

SUMMARY OF THE INVENTION

In view of the background thus far described in accordance with the prior art, therefore, it is an object of the present invention to provide a process of producing a cold-bonded iron ore which enables the use of iron ore particles of the normal grade.

Another object of the present invention is to provide a process of producing a cold-bonded iron ore which yields an increased angle of repose, satisfactory hot properties and a high cold strength.

A further object of the present invention is to provide a process of producing a cold-bonded iron ore which permits a sufficient gas flow to pass therethrough when it is fed to a blast furnace.

A further object of the present invention is to provide a process of producing a cold-bonded iron ore to which satisfactory hot properties can be imparted by adjusting the amount of a binder to be added and the pressure to be applied at the molding step of the ore thereby to control the void volume of the product.

According to a feature of the present invention, there is provided a process of producing a cold-bonded iron ore for use as a charge of a blast furnace, comprising the step of: molding a mixture of iron ore and a binder into a block; and hardening said block.

According to another feature of the present invention, there is provided a process of producing a cold-bonded iron ore for use as a charge of a blast furnace, comprising the steps of: molding a mixture of iron ore and a binder into a block; and hardening said block, wherein said iron ore contains 10 to 70 % of particles having a diameter ranging from 1 to 10 mm.

According to a further feature of the present invention, there is provided a process of producing a cold-bonded iron ore for use as a charge of a blast furnace, comprising the steps of: molding a mixture of iron ore and a binder into a block; hardening said block and crushing the hardened block to pieces of predetermined shape.

According to a further feature of the present invention, there is provided a process of producing a cold-bonded iron ore for use as a charge of a blast furnace, comprising the steps of: molding a mixture of iron ore and a binder into a block; hardening said block; and mixing said mixture with an additive prior to the molding step thereby to adjust the basicity of the mixture to 0.8 to 2.0.

According to a further feature of the present invention, there is provided a process of producing a cold-bonded iron ore for use as a charge of a blast furnace, comprising the steps of: molding a mixture of iron ore and a binder into a block; and hardening said block, wherein said molding step is conducted so that the void volume of the hardened block may be equal to or less than 25 %.

The block or the pieces obtained by crushing the block according to the invention has preferably an indeterminate shape, such as a shape and dimension generally similar to those of the sintered ore which is usually used as the blast-furnace charge. That is, the mixture may be molded into a block of such a shape and dimension, or the mixture may be molded into a block of a large dimension and then crushed into pieces of such a shape and dimension, after its hardening.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENTS

Figure 1:
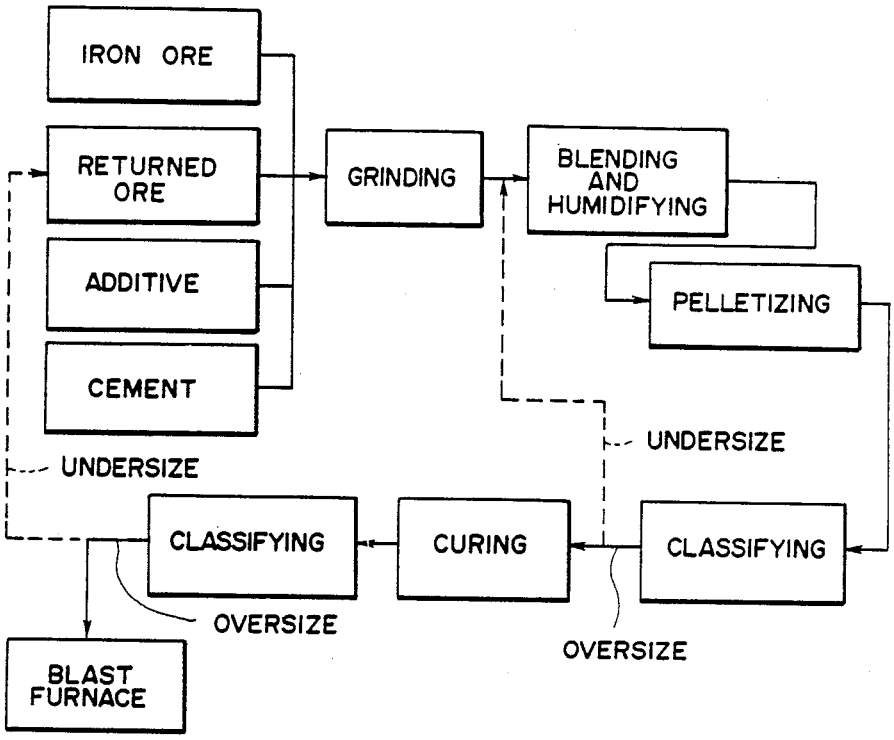
FIG.1 PRIOR ART
FIG. 1 is a flow chart showing one example of the process of producing cold-bonded pellets according to the prior art.
Figure 2:
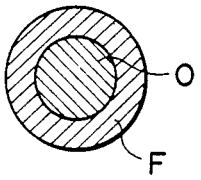
FIG. 2 is a sectional view illustrating the state of one cold-bonded pellet during reduction at an elevated temperature.

The cold-bonded pellets begin shrinking under load at 1000° to 1100° C. when they are reduced. During reduction, as shown in FIG. 2, the pellet has its surface reduced to a metallic iron portion F and its inside partially reduced to an iron monoxide (FeO) portion O. We, the Inventors, have investigated which portion takes part in the shrinkage at that temperature range. The results have revealed that the metallic iron portion F does not shrink up to a higher temperature whereas the iron monoxide portion O begins shrinking at a lower temperature. The softening of the FeO portion O is caused by a self-fluxing substance having a lower melting point which is formed by the reaction between the FeO and the gangue mineral. The formation of this self-fluxing substance depends upon the chemical composition of the gangue mineral.

Figure 3:
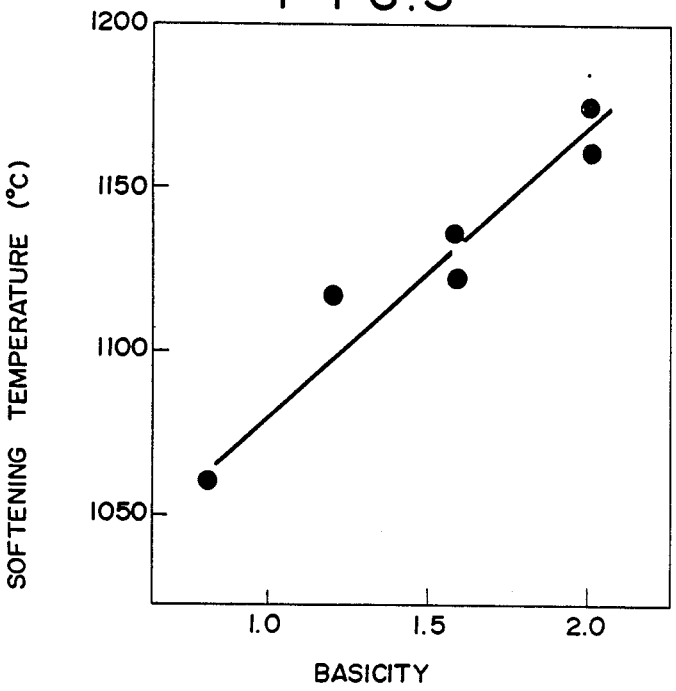
FIG. 3 is a graphical presentation illustrating the relationship between the basicity and the softening temperature of the same cold-bonded pellets.
Figure 4:
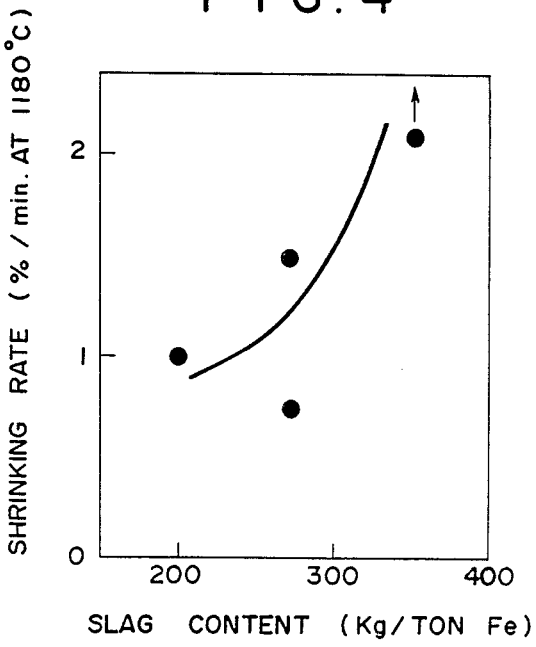
FIG. 4 is also a graphical presentation illustrating the relationship between the slag content and the shrinking rate of the same pellet.

FIG. 3 is a graph in which the softening temperature is plotted against the basicity. As illustrated, the softening temperature becomes higher for higher basicity so that more satisfactory hot properties can be enjoyed. Moreover, these hot properties are related to the softening rate, which in turn is highly dependent upon not only the composition but also on the slag content, as illustrated in FIG. 4.

From the results thus far described, it has been found to be effective for the improvement in the hot properties of the cold-bonded pellets that the basicity is increased and that the content of the gangue mineral is reduced, as has been put into practice in the prior art. According to this prior art method, however, the iron ore of ordinary grade cannot be used.

Therefore, we have made a variety of searches so as to enlarge the possibility of selection of the material ore. The results have also revealed that the iron ore can retain the satisfactory hot properties if it contains 10 to 70% of particles having a diameter ranging from 1 mm to 10 mm.

Figure 5:
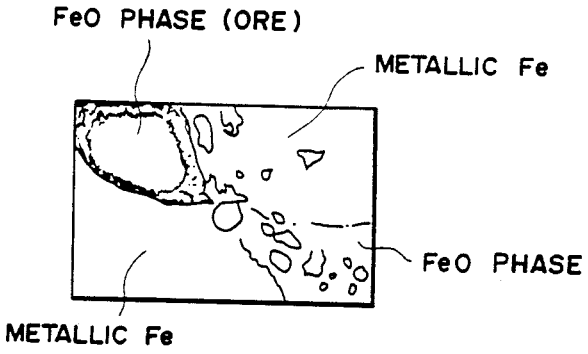
FIG. 5 is a schematic view based upon a microphotograph illustrating the particle structure of the cold-bonded iron ore, which has been reduced at a high temperature under load.

More specifically, we have observed such a sample of cold-bonded iron ore (which has been formed into a pellet or tablet shape and hardened) containing particles having various sizes are to be reduced at a temperature ranging from 1200° to 1250° C. The results have revealed that the particles smaller than 0.5 to 1 mm react with the cement and the additive to form a uniform melting structure whereas the particles larger than 1 mm are left as they are so that they hardly contribute to the softening and shrinking phenomena. FIG. 5 is an explanatory view based upon a microphotograph of the cold-bonded iron ore and illustrating the state of the FeO portion in case the iron ore is smaller than 5.6 mm. From FIG. 5, it is found that the iron ore larger than 1 mm is left as it is.

In view of FIG. 5, it is understood that the reaction between the ore particles and the cement occurs on the surface so that the component of the cement will not diffuse into the inside of the ore particles, and that the iron ore itself has a remarkably small content of gangue mineral.

Figure 6:
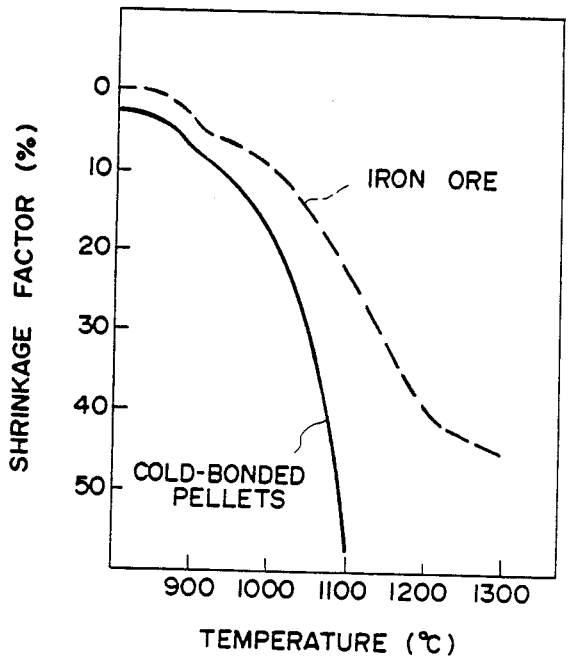
FIG. 6 is a graphical presentation illustrating the difference in shrinkage factor between the cold-bonded pellets and iron ore.

We have conducted a test for comparing the shrinking rates of the cold-bonded pellet and of the iron ore itself. The test result is plotted in FIG. 6. From FIG. 6, it can be understood that the ore itself is subject to little shrinkage, as compared with the cold-bonded pellets. From the findings that the reaction between the ore and the cement takes place in the surface layer of the ore, that the shrinkage factor of the ore itself is low and that the shrinking rate is small if the melting portion is small, we have further searched for the possibility of improving the hot properties if the ore having a particle size exceeding 1 mm is mixed for use.

Figure 7:
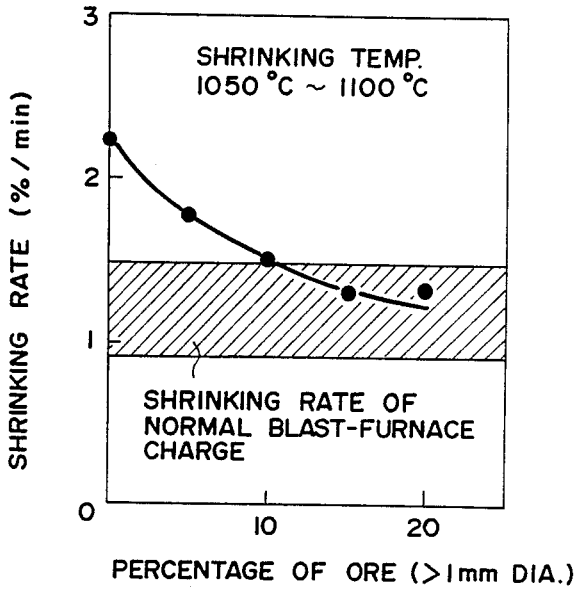
FIG. 7 is also a graphical presentation illustrating the relationship between the percentage of the ore particles having a diameter exceeding 1 mm and the shrinking rate of the same cold-bonded ore.

Therefore, we have investigated the hot properties by varying the composition of the ore larger than 1 mm. The results have revealed that the softening property such as the shrinking rate comparable with that of an ordinary blast-furnace charge can be achieved if the iron ore contains more than 10% of the particles having a diameter larger than 1 mm, as illustrated in FIG. 7.

Figure 8:
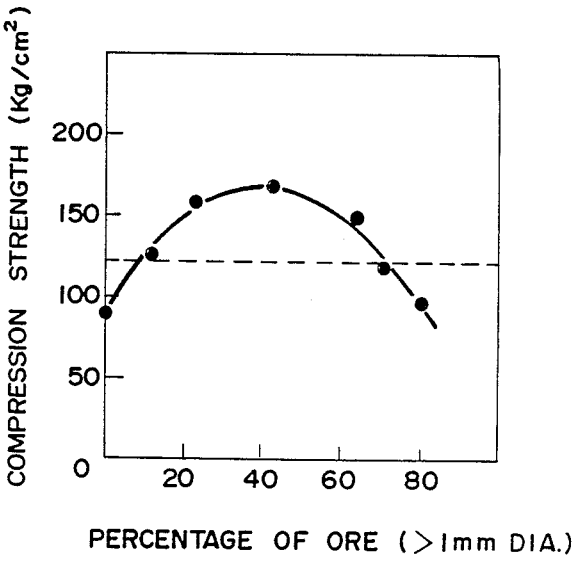
FIG. 8 is also a graphical presentation illustrating the relationship between the percentage of the particles having a diameter exceeding 1 mm in the same pellets and the compression strength.

Our investigations have further proceeded to the relationship between the percentage of the ore larger than 1 mm in dia. and the compression strength of the cold-bonded pellets which have a large content of ore particles larger than 1 mm. The results have revealed that the compression strength exceeds the target value of 120 kg/cm$^2$ for the range of 10 to 70% of the ore particles larger than 1 mm, as illustrated in FIG. 8, so that a satisfactory cold strength is exhibited. It is considered that the ore particles larger than 1 mm contribute to the improvement in the packing property but adversely affect this property if the iron ore content exceeds 70%.

Figure 9:
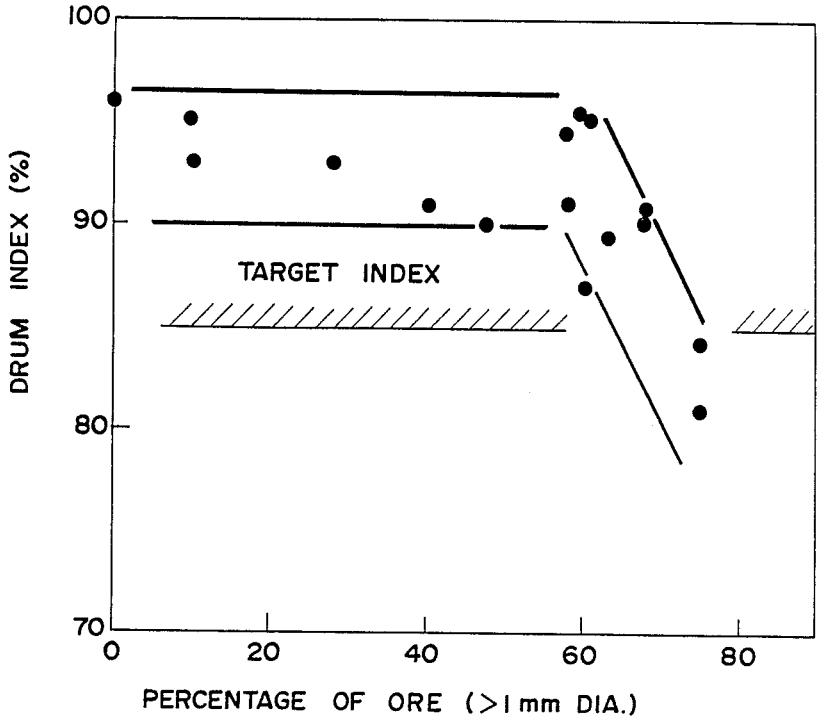
FIG. 9 is also a graphical presentation ilustrating the relatiohsip between the percentage of the particles having a diameter exceeding 1 mm in the same pellets and the drum index.

On the other hand, we have further investigated the relationship between the percentage of the ore larger than 1 mm in dia. and the tumbler index. The results have revealed, as illustrated in FIG. 9, that the practical target tumbler index of 85% can be attained, if the content of the ore having particle size larger than 1 mm is lower than 70%. From the above, one can understand that the hot properties become the better for the larger percentage of the particles larger than 1 mm whereas the packing property is deteriorated to the worse for the lower content of the fine iron ore.

From the revelations thus far described, the present invention is intended to use the iron ore containing 10 to 70% of particles having a diameter ranging from 1 to 10 mm.

Incidentally, the reason why the upper limit of the iron ore particles is set at 10 mm is that it is not necessary in the least for the iron ore larger than 10 mm to be bonded together.

In addition to the aforementioned feature that the iron ore containing 10 to 70% of particles having a diameter ranging from 1 to 10 mm is used, the present invention is further featured by the fact that the iron ore is molded into a block and is then crushed, after it has been hardened, to have a predetermined shape. The crushed pieces are shaped and sized to be suitable for the blast-furnace charge. For example, the shape may preferably be indeterminate, and size may preferably be 10 to 50 mm, as will be detailed hereinafter.

In the present invention, more specifically, the iron ore cannot be granulated by the pelletizer, as is different from the prior art, because it has a large content of iron ore particles larger than 1 mm in dia. For the pelletization, the iron ore has to be ground to a diameter smaller than 0.5 mm, preferably, 0.2 to 0.3 mm so that it raises the production cost. On the other hand, the pellets prepared by the pelletizer are so spherical that they cannot have a large angle of repose.

Thus, the present invention is further featured by that the hardened block is crushed to endow a large angle of repose.

Figure 10:
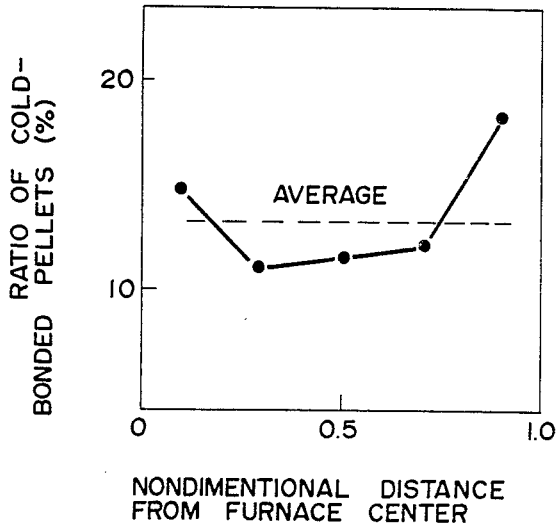
FIG. 10 is also a graphical presentation illustrating the relationship between the mixing ratio of the same pellets and the nondimensional distance from the furnace center.
Figure 11:
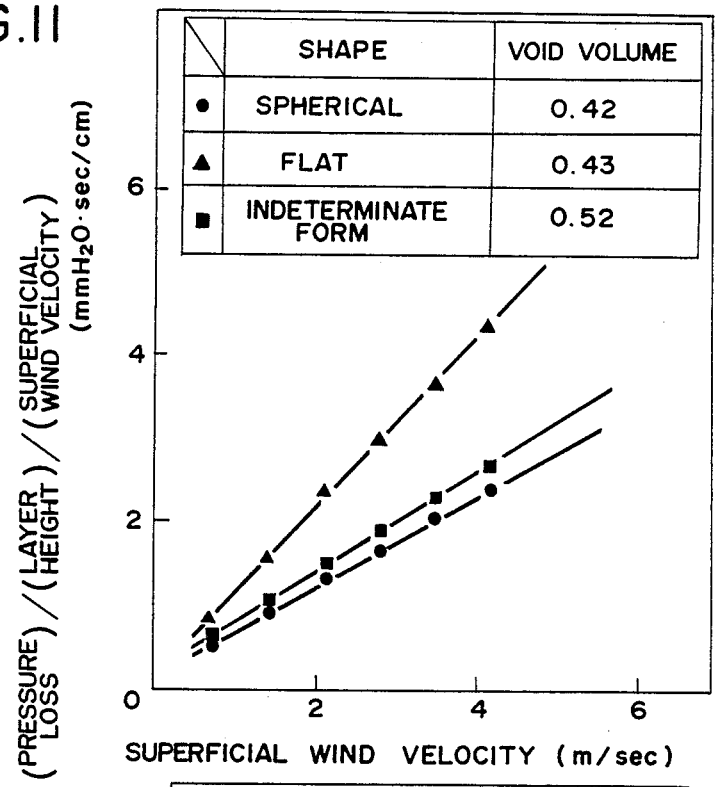
FIG. 11 is also a graphical presentation illustrating the relationship between the superficial wind velocity and the pressure loss at the layer which is charged with cold-bonded iron ore of different shapes.

The major part of the charges of the blast furnace, e.g., the pellets and the sintered ore respectively have angles of repose of 25 degrees and 30 degrees. The cold-bonded iron ore which is generated by crushing the hardened block has an angle of repose of about 31 degrees. This value is similar to that of the sintered ore having such an excellent shape that ensures a more excellent charge or charge distribution than that of the pellets of the prior art, as illustrated in FIG. 10. The indeterminate shape of the cold-bonded ore prepared according to the present invention also enhances a prominent effect upon the improvement in the resistance to the air flow in the blast-furnace charge. We have conducted experiments for determining the pressure losses of the overlaid layers of various shapes of the cold-bonded iron ore, as are plotted against the superficial wind velocity in FIG. 11. As is apparent from this Figure, the pressure loss at the overlaid layer of the cold-bonded ore having an indeterminate shape according to the present invention is so low that a satisfactory gas flow can be established.

Incidentally, the molding process of the coarse iron ore can be easily conducted by the technique which is used in the field of the concrete, for example. On the other hand, the molding process may be effected by means of a frame, preferably with vibrations. Moreover, the process of crushing the hardened block into indeterminate shapes having a predetermined diameter can be easily effected by the use of a jaw crusher which is used for crushing sintered iron ore, for example.

According to the features of the present invention thus far described, it is possible to use the material, of which major part consists of iron ore particles having a diameter larger than 1 mm. In the present invention, water has to be added in case solid cement powder is used as the binder. In case, however, a liquid binder is used, water need not be added.

Figure 12:
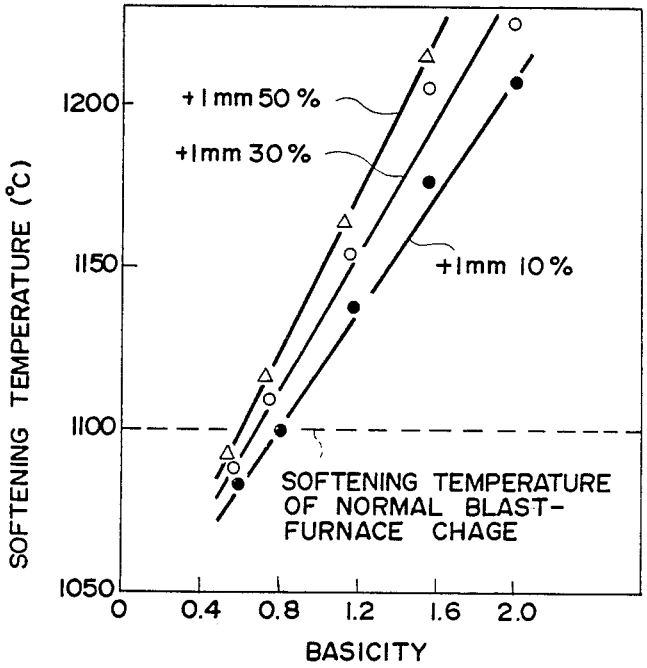
FIG. 12 is also a graphical presentation illustrating the relationship between the softening temperature and the basicity in a reducing atmosphere of the same cold-bonded iron ore.

We have further investigated the hot properties by measuring the softening point of the cold-bonded pellets of the invention in a reducing atmosphere. The results have revealed, as illustrated in FIG. 12, that in case the cold-bonded iron ore contains more than 10% of particles larger than 1 mm it softens at a temperature higher than 1100° C. for a basicity higher than 0.8, as is similar to the case of the ordinary blast-furnace charge, and that the softening temperature becomes higher the higher the content of the ore particles larger than 1 mm. Incidentally, the conventional cold-bonded pellets not containing the coarse iron ore particles larger than 1 mm fail to have their softening temperature at 1100° C., unless their basicity exceeds a level of 1.2 to 1.3.

It can be understood from these results that the finer iron ore particles have a larger tendency to react with the cement and the additive than the coarser iron ore particles, which play a role as an aggregate to prevent the overall cold-bonded ore from softening. Thus, the cold-bonded iron ore containing a large part of particles larger than 1 mm exhibits a higher softening temperature even with a relatively low basicity.

Figure 13:
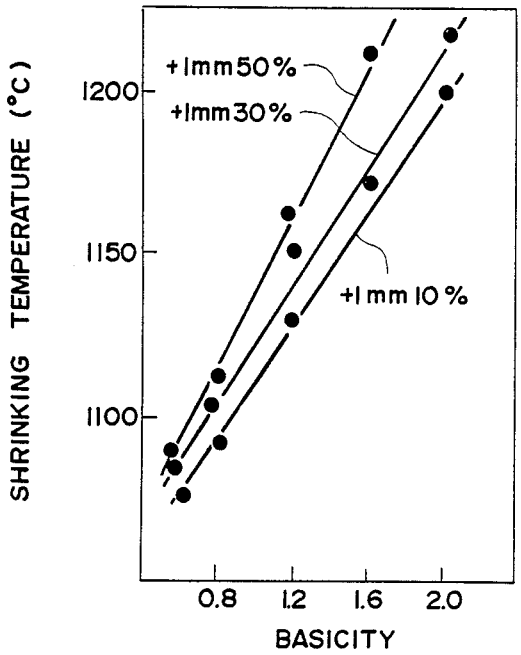
FIG. 13 is also a graphical presentation illustrating the relationship between the shrinking temperature and the basicity of the same cold-bonded ore.

On the other hand, the cold-bonded (or non-fired agglomerated) iron ore usually has its hot properties hardly depending upon the basicity ($CaO/SiO_2$) but its shrinking rate prominently depending upon the same in case it contains a large amount of an acidic oxide such as $SiO_2$ or $Al_2O_3$, as illustrated in FIG. 13. Even in this case, however, the satisfactory hot properties can be found obtainable if the basicity is raised to exceed 0.8.

Moreover, the reason why the upper limit of the basicity is set at 2.0 comes from the fact that the increase in the content of the additive such as CaO gives rise to not only the content of the gangue mineral but also the production cost thereby unfavorably affecting the process economics.

Thus, according to a feature of the present invention, an addition may be added to the mixture of the iron particles and the binder thereby to adjust the basicity of the mixture to fall within a range of 0.8 to 2.0. This addition is optional, because when an iron ore containing a small amount of $SiO_2$ is used the basicity of the mixture composed of the iron ore and the cement may possibly exceed 0.8.

According to another feature of the present invention, the molding step is conducted so that the void volume of the hardened block may be equal to or less than 25%. This embodiment is preferably particularly when iron ore particles having a diameter smaller than 1 mm are used. Such molding step may be effected by a pressure-molding method, a shock-molding method or a packing-molding method with vibrations. It should be noted that the void volume herein, referred is different from the so-called "porosity". More specifically, the volume occupied by the pores in the ore particles themselves is not counted up for calculating the void volume.

The reason why the void volume should be restricted not to exceed 25% will be described in the following.

Figure 14:
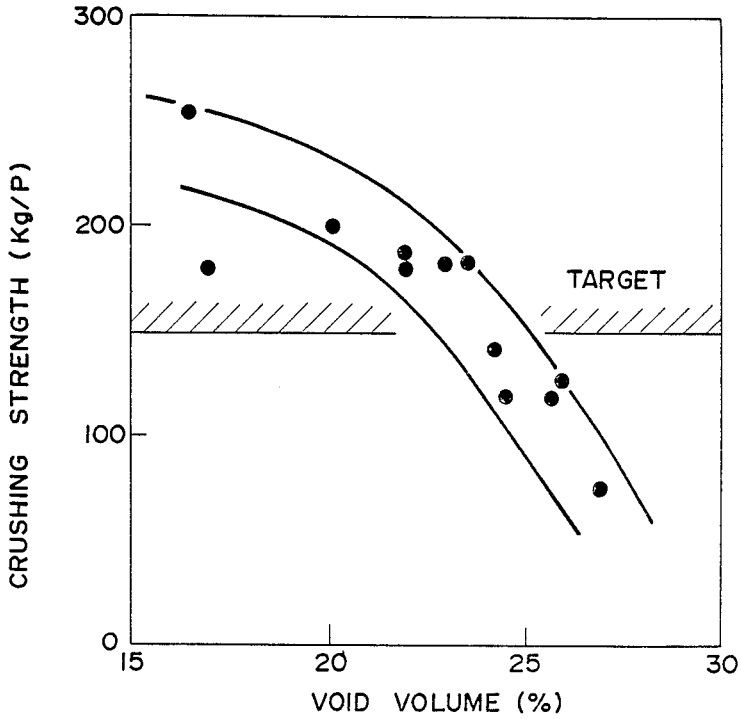
FIG. 14 is also a graphical presentation illustrating the relationship between the void volume and the crushing strength of the cold-bonded iron ore.

Turning to FIG. 14, there are illustrated the results of the investigations of the relationship between the crushing strength and the void volume of the cold-bonded iron ore which has been produced by the pressure-molding method from the iron ore particles having a diameter smaller than 1 mm. From that Figure, it can be found that the crushing strength is improved with the decrease in the void volume until it exceeds such a target value of 150 kg/P for the void volume lower than 25% as allows the ore product to have a sufficient handling strength.

Figure 15:
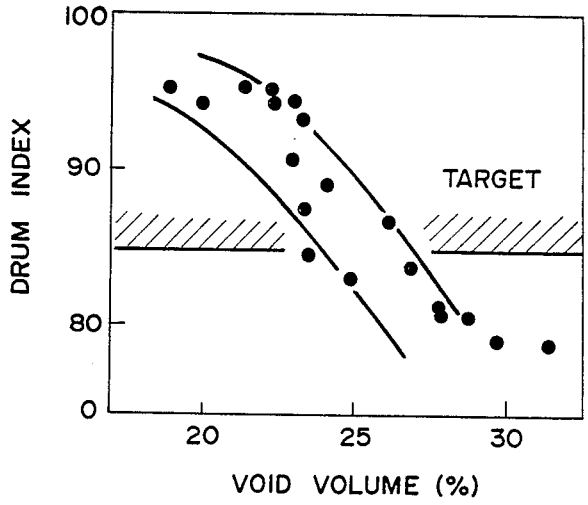
FIG. 15 is also a graphical presentation illustrating the relationship between the void volume and the drum index of the same.

We have further investigated the relationship between the void volume and the drum index of the cold-bonded iron ore which has been produced by the pressure-molding method from iron ore particles having a diameter smaller than 10 mm. The results of our investigations are plotted in FIG. 15. From this Figure, it has been found that the drum index is increased to enhance the strength with the decrease in the void volume even in case the iron ore used has a diameter smaller than 10 mm and that the target drum index higher than 85 can be retained for the void volume lower than 25%.

Figure 16:
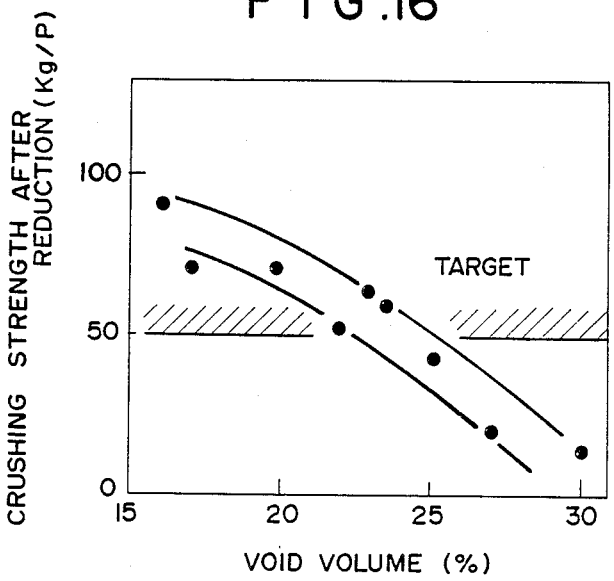
FIG. 16 is also a graphical presentation illustrating the relationship between the void volume and the crushing strength after reduction of the same.
Figure 17:
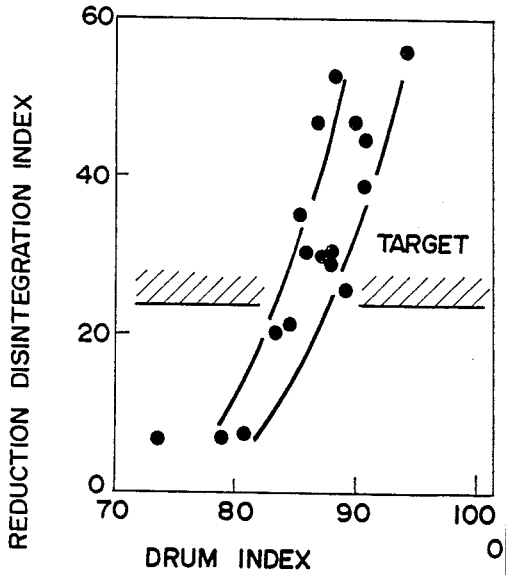
FIG. 17 is also a graphical presentation illustrating the relationship between the drum index and the disintegration index during reduction of the same.

In order to examine the strength after reduction, our efforts have further been devoted to reveal the relationships between the crushing strength after reduction, and the disintegration index during reduction, both of which give indices to the deterioration in strength, and the void volume. The investigations have revealed the following results. That is to say, from FIG. 16 illustrating the relationship between the crushing strength after reduction and the void volume of the cold-bonded iron ore which has been produced by the pressure-molding method from iron ore having a particle diameter smaller than 1 mm, it can be found that the void volume may be set at a value smaller than 25%, preferably, 23% so as to attain the target crushing strength of 50 kg/P after reduction. On the other hand, FIG. 17 illustrates the relationship between the tumbler index and the reduction disintegration index in case the iron ore has a particle size smaller than 10 mm. From this Figure, it can also be found that the target reduction disintegration index of the sintered iron ore makes it necessary to set the drum index at a value larger than 83, preferably 88, which corresponds to the situation for the void volume of 25% in FIG. 15.

As is now apparent from the results thus far described, the cold-bonded iron ore having a high cold strength and little distintegration during reduction can be produced according to the present invention, provided that the void volume is set at a value smaller than 25%, preferably 23% in case the cold-bonded ore is to be produced by the pressure-molding or shock-molding method from the ore particles or by the packing-molding method with vibrations. Therefore, the present invention is featured by the fact that the product has a void volume not exceeding 25%.

The present invention will be described in more detail in connection with the following Examples:

[EXAMPLE 1]

The materials, which had a composition tabulated in Table 1 and a particle size tabulated in Table 2, were blended and molded into a block having a size of 500 mm (W)×1000 mm (L)×200 mm (T). This block was then cured for ten days. The cured block was crushed by means of a crusher into cold-bonded iron ore pieces having an average diameter of 15 mm. The resultant iron ore product had such characteristics as are tabulated in Table 3. In this Table, the characteristics of the cold-bonded ore thus obtained, the fired pellets and the sintered iron ore are also tabulated for reference to the prior art.

As is apparent from Table 3, the product according to the present invention can enjoy excellent hot properties such as the reducibility, the pressure loss and so on because the component larger than 1 mm is much higher, notwithstanding it is made of iron ore of lower grade having a slightly higher slag content.

TABLE 1

| | Chemical Composition (wt %) | | | | | |
|---|---|---|---|---|---|---|
| | T.Fe | $SiO_2$ | $Al_2O_3$ | CaO | MgO | Remarks |
| A | 68 | 0.5 | 1.0 | — | — | Hematite Ore |
| B | 62 | 4.8 | 2.7 | 0.1 | 0.1 | Hematite Ore |
| C | 56 | 5.1 | 1.6 | 1.0 | 1.3 | Magnetite Ore |
| D | — | 0.8 | — | 54.8 | 0.4 | Limestone Powder |
| E | — | 8.0 | 0.2 | 35.0 | 16.6 | Dolomite Powder |

TABLE 1-continued

| | Chemical Composition (wt %) | | | | | |
|---|---|---|---|---|---|---|
| | T.Fe | $SiO_2$ | $Al_2O_3$ | CaO | MgO | Remarks |
| F | 2 | 21.7 | 5.1 | 65.1 | 1.0 | Portland Cement |

TABLE 2

| Ratio (wt %) | A | B | C | D | E | F |
|---|---|---|---|---|---|---|
| 10–1 mm | 62 | 55 | — | — | — | — |
| < -1 mm | 38 | 45 | 100 | 100 | 100 | 100 |

TABLE 3

| | Present Invention | | | Prior Art (Pellets) | | | Comparison | |
|---|---|---|---|---|---|---|---|---|
| | P-1 | P-2 | P-3 | P-4 | P-5 | P-6 | Self-Fluxing Fired Pellets | Self-Fluxing Sintered Ore |
| Production conditions | | | | | | | | |
| Ratio of coarse ore (21 mm) | 60 | 45 | 15 | 0 | 0 | 0 | — | — |
| $CaO/SiO_2$ | 1.5 | 1.4 | 1.5 | 1.2 | 2.1 | 2.0 | | |
| Slang Content (Kg/Fe-Ton) | 351 | 226 | 341 | 216 | 307 | 187 | — | — |
| Drum Index (%) | 93 | 94 | 92 | 96 | 93 | 96 | 99 | 96 |
| Hot properties (at 1300° C.) | | | | | | | | |
| Pressure drop | 340 | 100 | 230 | 1000 | 415 | 460 | 340 | 230 |
| Shrinkage factor (%) | 67 | 62 | 69 | 70 | 62 | 67 | 70 | 60 |
| Reducibility (%) | 80 | 82 | 86 | — | 65 | 73 | 60 | 83 |

[EXAMPLE 2]

The materials, which had a composition tabulated in Table 4 and a particle size tabulated in Table 5, were blended at ratios tabulated in Table 6 and were pressure-molded with vibrations into a block having a size of 250 mm (W)×400 mm (L)×100 mm (T). After having been cured for ten days, the block was crushed by a crusher into cold-bonded iron ore pieces having an average diameter of 15 mm.

TABLE 4

| | Chemical Composition (%) | | | | | |
|---|---|---|---|---|---|---|
| | T.Fe | $SiO_2$ | $Al_2O_3$ | CaO | Mgo | Remarks |
| A | 68 | 0.5 | 1.0 | — | — | Hematic Ore |
| B | 67 | 1.0 | 1,3 | — | — | Hematite Ore |
| C | 62 | 4.8 | 2.7 | 0.1 | 0.1 | Hematite Ore |
| D | 56 | 5.1 | 1.6 | 1.0 | 1.3 | Magnetite Ore |
| E | — | 0.8 | — | 54.8 | 0.4 | Limestone Powder |
| F | — | 3.0 | 0.2 | 35.0 | 16.6 | Dolomite Powder |
| G | 2 | 21.7 | 5.1 | 65.1 | 1.0 | Portland Cement |

TABLE 5

| Ratio (wt %) | A | B | C | D | E | F | G |
|---|---|---|---|---|---|---|---|
| 10–1 mm | 62 | — | 55 | — | — | — | — |
| less than 1 mm | 38 | 100 | 45 | 100 | 100 | 100 | 100 |

TABLE 6

| | Materials mixed | | | | | | |
|---|---|---|---|---|---|---|---|
| Samples | A | B | C | D | E | F | G |
| P1 | — | 30 | 22 | 41 | — | — | 7 |
| P2 | — | 26 | 22 | 40 | 2 | 2 | 8 |
| P3 | — | — | 50 | 42 | — | — | 8 |
| P4 | 20 | 25 | 30 | 15 | 2 | — | 8 |
| P5 | — | — | 92 | — | — | — | 8 |
| P6 | 38 | — | 50 | — | 4 | — | 8 |

The characteristics of the resultant product are tabulated in Table 7. In this Table, incidentally, the characteristics of the cold-bonded pellets, the fired pellets and the sintered iron ore are also tabulated for reference to the prior art.

TABLE 7

| | Present Invention | | | | | |
|---|---|---|---|---|---|---|
| | P1 | P2 | P3 | P4 | P5 | P6 |
| Production conditions | | | | | | |
| Ratio of coarse ore (21 mm) (%) | 13 | 14 | 30 | 32 | 55 | 58 |
| $CaO/SiO_2$ | 1.0 | 1.4 | 0.9 | 1.5 | 0.9 | 1.7 |
| Slag Content (Kg/Fe - Ton) | 221 | 290 | 276 | 228 | 254 | 247 |
| Hot Properties | | | | | | |
| Pressure drop (mm Ag.) | 340 | 150 | 220 | 120 | 200 | 160 |
| Shrinkage Factor (%) | 69 | 64 | 66 | 61 | 65 | 62 |
| Reducibility (%) | 85 | 86 | 82 | 88 | 80 | 82 |

TABLE 7

| Prior Arts (Cold Pellets) | | | Comparison | |
|---|---|---|---|---|
| P7 | P8 | P9 | Self-Fluxing Fired Pellets | Self-Fluxing Sintered Ore |
| 0 | 0 | 0 | — | — |
| 1.2 | 2.1 | 2.0 | — | — |
| 216 | 307 | 187 | — | — |
| 1000 | 415 | 460 | 340 | 230 |
| 70 | 62 | 67 | 70 | 60 |
| — | 65 | 73 | 60 | 83 |

As is apparent from the Table 3, the product according to the present invention can enjoy the excellent hot properties such as reducibility, pressure loss and so on partly because the component larger than 1 mm is much higher and partly because the basicity is made equal to or higher than 0.8, notwithstanding it is made of iron ore of lower grade having a slightly higher slag content.

[EXAMPLE 3]

Figure 18:
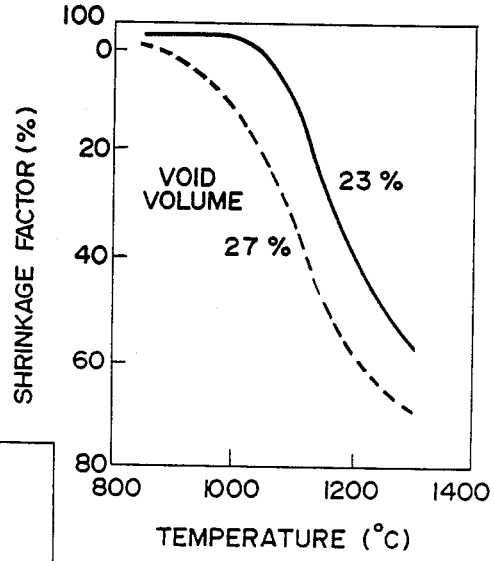
FIGS. 18 and 19 are also graphical presentations illustrating the softening test results at high temperatures and under load according to the present invention.

The hematite ore having a diameter smaller than 1 mm, the limestone powder and Portland cement, all of which had compositions tabulated in Table 8, were mixed. The resultant mixture was then molded by means of a briquetting machine having a linear pressure of 5 to 10 tons/cm into cold-bonded briquettes of almond shape (16 mm (W)×24 mm (L)×12 to 13 mm (T)) respectively having void volumes of 23% and 27%. As to the briquettes thus prepared, the investigated results of the cold strength and the strength during reduction were tabulated in Table 9, and the investigated results of the softening properties at high temperatures and under load were plotted against temperature in FIG. 18. As is apparent from the results tabulated in Table 9, the briquettes having the void volume of 23% falling within the range of the present invention exhibited such values as could sufficiently satisfy the targets of both the cold strength and the strength after reduction. As to the hot softening properties, moreover, it was also found that the briquettes having the void volume of 27% falling outside the range of the present invention abruptly shrinked around 900° C. due to the disintegration resulting from the reduction whereas the briquettes having the void volume of 23% softened and shrinked around 1100° C. so that they could retain the satisfactory properties.

TABLE 8

| | Chemical Composition (%) | | | | |
|---|---|---|---|---|---|
| | T.Fe | $SiO_2$ | $Al_2O_3$ | CaO | MgO |
| Hematic Ore | 62.0 | 4.8 | 2.7 | 0.1 | 0.7 |
| Limestone Powder | 0 | 0.8 | 0 | 54.0 | 0.4 |
| Portland Cement | 2.3 | 21.7 | 5.1 | 65.1 | 1.0 |

TABLE 9

| | Void Volume (%) | Cold Strength (Kg/P) | Strength after Reduction (Kg/P) |
|---|---|---|---|
| Present invention | 23 | 180 | 50 |
| Comparison | 27 | 78 | 20 |

[EXAMPLE 4]

Figure 19:
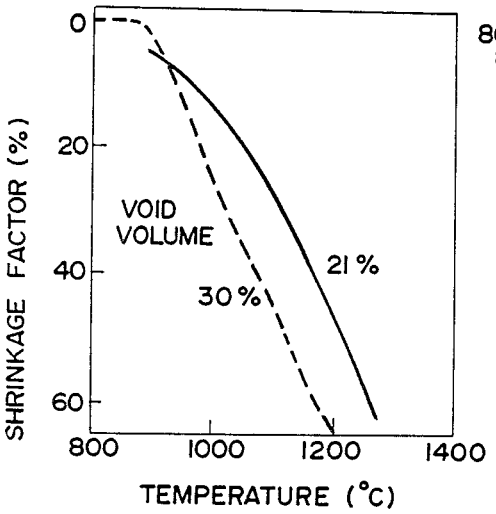

The hematite ore having a diameter smaller than 8 mm, the limestone powder having a diameter smaller than 5 mm, and the Portland cement, all of which had compositions tabulated in the foregoing Table 8, were mixed. The resultant mixture was then pressure-molded with virbrations into cold-bonded ore pieces (having a size of 10×20 mm), which respectively had void volumes of 21% and 30%. As to the cold-bonded ore product thus made, the tumbler index and the disintegration index during reduction were tabulated in Table 10, and the softening properties at high temperatures and under load were plotted against the temperature in FIG. 19.

As is apparent from the results tabulated in Table 10, the cold-bonded iron ore product of the present invention could achieve the target values of both the tumbler index and the reduction disintegration index and could exhibit the satisfactory hot properties without any abrupt shrinkage due to the disintegration.

TABLE 10

| | Void Volume (%) | Drum Index | Disintegration Index during Reduction |
|---|---|---|---|
| Present invention | 21 | 95 | 56 |
| Comparsion | 30 | 79 | 7 |

[EXAMPLE 5]

The materials, which had a composition and a particle size tabulated in Table 11, were blended and humidified. The thus obtained mixture was molded into a frame in form of a cube of 200 mm×200 mm×200 mm under a load of 1.5 kg/cm$^2$ applied on the upper side while vibrating the frame for 20 seconds with a frequency of 100 Hz. The molded block was then cured for 10 hours in a vapour at 50° C. and then crushed into pieces having a maximum diameter of 10 mm. The crushed pieces were laid in a stocking yard for 2 weeks and then subjected to a secondary crushing and classifying step. The resultant over-sized cold-bonded ore product having a diameter of 5 to 50 mm exhibited properties shown in Table 12.

TABLE 11

| | Ratio | Chemical Component (%) | | | | | |
|---|---|---|---|---|---|---|---|
| | % | T.Fe | $SiO_2$ | $Al_2O_3$ | CaO | MgO | F.C |
| Ore A | 77 | 62.0 | 48 | 2.7 | 0 | 0 | 0 |
| Ore B | 9 | 68.3 | 0.5 | 1.0 | 0.1 | 0.1 | 0 |
| Lime Stone | 5 | 0 | 2.9 | 0 | 53.8 | 0 | 0 |
| Coke | 3 | 2.4 | 6.3 | 3.3 | 0.8 | 0.4 | 87.0 |
| Portland Cement | 3 | 2.2 | 22.2 | 5.1 | 65.1 | 1.4 | 0 |
| Glassy Blast Furnace Slag | 3 | 0.4 | 32.5 | 13.7 | 40.5 | 5.9 | 0 |

TABLE 11

(Suite)

| Size Fraction (%) | | | | | |
|---|---|---|---|---|---|
| 10–7 | 7–5 | 5–2 | 2–1 | 1–0.5 | 0.5 |
| 8.1 | 10.2 | 22.2 | 14.0 | 10.4 | 35.1 |
| 0 | 0 | 0 | 0 | 0 | 100.0 |
| 0 | 0.5 | 26.8 | 21.8 | 11.2 | 39.7 |
| 3.6 | 3.6 | 12.9 | 14.1 | 16.6 | 49.2 |
| 0 | 0 | 0 | 0 | 0 | 100.0 |
| 0 | 0 | 0 | 0 | 0 | 100.0 |

TABLE 12

| | | |
|---|---|---|
| Properties of raw materials | T. Fe (%) | 54.0 |
| | Fixed Carbon (%) | 2.6 |
| | Slag Content (Kg/Ton - Fe) | 290.0 |
| | Basicity ($CaO/SiO_2$) | 1.04 |
| | Ratio of Coarse Ore (1 mm) (%) | 48.4 |
| Forming properties | Density (g/cm$^3$) | 3.93 |
| | Apparent density (g/cm$^3$) | 3.38 |
| | Void volume (%) | 14.0 |
| Cold | Drum Index (%) | 93 |
| | Crushing strength (Kg/P) | 180 |

TABLE 12

(suite)

| | | |
|---|---|---|
| Properties Reduction | Reduction disintegration Index (%) | 148 |
| | Crushing strength after | 64 |

TABLE 12-continued

| | (suite) | |
|---|---|---|
| | reduction (Kg/P) | |
| Hot | Pressure drop at 1300° C. (mm Ag) | 377 |
| | Shinkage factor at 1300° C. (%) | 64 |

The resultant cold-bonded ore product was charged to the blast furnace together with the other blast-furnace charges at a ratio as shown in Table 13, with a good operating result.

TABLE 13

| | |
|---|---|
| Sinter | 55.0% |
| Lump Ore | 17.0% |
| Fired Pellet | 13.0% |
| Cold-bonded Ore | 15.0% |

[EXAMPLE 6]

The materials, which had a composition and a particle size tabulated respectively in the afore-mentioned Tables 1 and 2, were blended with coke in an amount indicated in Table 14. With this mixture, the cold-bonded ore was prepared under the same conditions as those of Example 1.

The characteristics of the obtained ore are shown in Table 14, together with those of the cold-bonded pellet for comparison.

TABLE 14

| | Present Invention (cold-bonded ore) | Prior Art (Pellet) |
|---|---|---|
| Production conditions | | |
| Ratio of coarse ore (1 mm) (%) | 60 | 0 |
| $CaO/SiO_2$ | 1.5 | 1.6 |
| Slag content (Kg/Fe-ton) | 351 | 340 |
| Coke content (%) | 5 | 5 |
| Drum Index (%) | 90 | 92 |
| Hot properties (at 1300° C.) | | |
| Pressure drop (mm Aq) | 410 | 1100 |
| Shrinkage Factor | 79 | 86 |
| Reducibility (%) | 93 | 94 |

What we claim:

1. A process for producing cold-bonded iron ore and for using said iron ore as a blast-furnace charge, comprising the steps of:

molding a mixture of iron one and a binder into a block, said iron containing 10 to 70% of particles having a diameter ranging from 1 to 10 mm wherein said block is of a size such that it requires crushing to a size suitable for a blast-furnace charge;

hardening said block;

crushing said hardened block into particles of predetermined shape having a particle size of 10 to 50 mm; and introducing said crushed particles of predetermined shape into a blast furnace.

2. A process for producing and using cold-bonded iron ore as a blast-furnace charge according to claim 1, wherein said binder is selected from the group of hydraulic substances consisting of Portland cement, blast-furnace cement and blast-furnace slag.

3. A process for producing and using cold-bonded iron ore as a blast-furnace charge according to claim 1, further comprising the step of adding a solid reducer to said mixture prior to said molding step.

4. A process for producing and using cold-bonded iron ore as a blast-furnace charge according to claim 1, wherein said hardening step is effected by a curing treatment.

5. A process for producing and using cold-bonded iron ore as a blast-furnace charge according to claim 1, further comprising the step of mixing said mixture with an additive prior to said molding step thereby to adjust the basicity of said mixture.

6. A process for producing and using cold-bonded iron ore as a blast-furnace charge according to claim 1, wherein said molding step is effected by a pressure-molding method, a shock-molding method or a packing-molding method with vibrations.

7. A process for producing and using cold-bonded iron ore as a blast-furnace charge according to claim 1 wherein said hardened block has a void volume not exceeding 25%.

8. A process of producing cold-bonded iron ore and for using said iron ore as a blast-furnace charge, comprising the steps of:

(a) forming a mixture of iron ore containing 10 to 70% of particles having a diameter ranging from 1 to 10 mm, binder, a solid reducing agent and an additive to adjust the basicity of said mixture to 0.8 to 2.0;

(b) molding said mixture into a block;

(c) hardening said block by a curing treatment whereby said hardened block has a void volume not exceeding 25%;

(d) crushing said block into particles of indeterminate shape and having a particle size of 10 to 50 mm; and (e) introducing said indeterminate shaped particles into a blast furnace.

9. A process for producing and using cold-bonded iron ore as a blast-furnace charge according to claim 8, wherein said binder is selected from the group of hydraulic substances consisting of Portland cement, blast-furnace cement and blast-furnace slag.

10. A process for producing and using cold-bonded iron ore as a blast-furnace charge according to claim 8, wherein said molding step is effected by a pressure molding method, a shock-molding method or a packing-molding method with vibrations.

11. A process for producing and using cold-bonded iron ore as a blast-furnace charge according to claim 8, wherein said additive is at least one of calcium oxide, aluminum oxide and magnesium oxide.

12. A process for producing and using cold-bonded iron ore as a blast-furnace charge according to claim 8, wherein said void volume does not exceed 23%.

* * * * *